US010462584B2

(12) United States Patent
Aubreville et al.

(10) Patent No.: US 10,462,584 B2
(45) Date of Patent: Oct. 29, 2019

(54) METHOD FOR OPERATING A HEARING APPARATUS, AND HEARING APPARATUS

(71) Applicant: SIVANTOS PTE. LTD., Singapore (SG)

(72) Inventors: Marc Aubreville, Nuremberg (DE); Marko Lugger, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/941,106

(22) Filed: Mar. 30, 2018

(65) Prior Publication Data

US 2018/0288534 A1 Oct. 4, 2018

(30) Foreign Application Priority Data

Apr. 3, 2017 (DE) ..... 10 2017 205 652

(51) Int. Cl.
*H04R 25/00* (2006.01)
*H04R 3/00* (2006.01)
(Continued)

(52) U.S. Cl.
CPC ..... *H04R 25/505* (2013.01); *G10L 21/02* (2013.01); *G10L 25/81* (2013.01); *G10L 25/84* (2013.01);
(Continued)

(58) Field of Classification Search
CPC ..... G10L 21/02; G10L 25/81; G10L 25/84; G10L 25/51; G10L 25/507; G10L 25/00; G10L 25/03; G10L 25/27; G10L 25/30; G10L 25/33; G10L 2025/783; G10L 2025/786; H04R 25/43; H04R 25/505;
(Continued)

(56) References Cited

U.S. PATENT DOCUMENTS 5,734,793 A * 3/1998 Wang ..... G10L 15/02 704/232
7,343,023 B2 3/2008 Nordqvist et al.
(Continued)

FOREIGN PATENT DOCUMENTS

DE 60120949 T2 7/2007
DE 102014207311 A1 3/2015
(Continued)

*Primary Examiner* — Md S Elahee
*Assistant Examiner* — Angelica M McKinney
(74) *Attorney, Agent, or Firm* — Laurence A. Greenberg; Werner H. Stemer; Ralph E. Locher

(57) ABSTRACT

A method for operating a hearing apparatus that has a microphone for converting ambient sound into a microphone signal, involves a number of features being derived from the microphone signal. Three classifiers, which are implemented independently of one another for analyzing a respective assigned acoustic dimension, are each supplied with a specifically assigned selection from these features. The respective classifier is used to generate a respective piece of information about a manifestation of the acoustic dimension assigned to the classifier. At least one of the at least three pieces of information about the respective manifestation of the assigned acoustic dimension is then taken as a basis for altering a signal processing algorithm that is executed for the purpose of processing the microphone signal to produce an output signal.

14 Claims, 2 Drawing Sheets

(51) Int. Cl.
*G10L 25/81* (2013.01)
*G10L 25/84* (2013.01)
*G10L 21/02* (2013.01)

(52) U.S. Cl.
CPC ..... *H04R 3/00* (2013.01); *H04R 25/00* (2013.01); *H04R 25/43* (2013.01); *H04R 25/507* (2013.01); *H04R 25/70* (2013.01); *H04R 2225/39* (2013.01); *H04R 2225/41* (2013.01); *H04R 2225/43* (2013.01)

(58) Field of Classification Search
CPC .... H04R 25/507; H04R 3/00; H04R 2225/43; H04R 2225/41
See application file for complete search history.

(56) References Cited

U.S. PATENT DOCUMENTS 7,995,781 B2 * 8/2011 Allegro Baumann ..... H04R 25/505 381/312
8,249,284 B2 * 8/2012 Allegro-Baumann ..... H04R 25/407 381/309
8,477,972 B2 7/2013 Buhmann et al.
9,294,848 B2 3/2016 Barthel et al.
2002/0191799 A1 * 12/2002 Nordqvist ..... H04R 25/505 381/60
2003/0144838 A1 7/2003 Allegro
2010/0027820 A1 * 2/2010 Kates ..... G10L 25/00 381/312
2013/0322668 A1 12/2013 Zhang et al.
2018/0220243 A1 * 8/2018 Nielsen ..... G10L 21/02

FOREIGN PATENT DOCUMENTS

EP 1858291 A1 11/2007
EP 2670168 A1 12/2013
WO 2008084116 A2 7/2008
WO 2013110348 A1 8/2013
WO 2017059881 A1 4/2017

* cited by examiner

METHOD FOR OPERATING A HEARING APPARATUS, AND HEARING APPARATUS

CROSS-REFERENCE TO RELATED APPLICATION

This application claims the priority, under 35 U.S.C. § 119, of German application DE 10 2017 205 652.5, filed Apr. 3, 2017; the prior application is herewith incorporated by reference in its entirety.

BACKGROUND OF THE INVENTION

Field of the Invention

The invention relates to a method for operating a hearing apparatus and to a hearing apparatus that is in particular set up to perform the method.

Hearing apparatuses are usually used for outputting a sound signal to the ear of the wearer of this hearing apparatus. In this case, the output is provided by an output transducer, for the most part acoustically by means of airborne sound using a loudspeaker (also referred to as a receiver). Frequently, such hearing apparatuses are used as what are known as hearing aids (also: hearing devices) in this case. In this regard, the hearing apparatuses normally comprise an acoustic input transducer (in particular a microphone) and a signal processor that is set up to use at least one signaling processing algorithm, usually stored on a user specific basis, to process the input signal (also: microphone signal) produced by the input transducer from the ambient sound such that a hearing loss of the wearer of the hearing apparatus is at least partially compensated for. In particular in the case of a hearing aid, the output transducer may be not only a loudspeaker but also, alternatively, what is known as a bone conduction receiver or a cochlear implant, which are set up to mechanically or electrically couple the sound signal into the ear of the wearer. The term hearing apparatuses additionally in particular also covers devices such as what are known as tinnitus maskers, headsets, headphones and the like.

Modern hearing apparatuses, in particular hearing aids, frequently comprise what is known as a classifier, which is usually configured as part of the signal processor that executes the or the respective signal processing algorithm. Such a classifier is usually in turn an algorithm that is used to infer a present hearing situation on the basis of the ambient sound captured by the microphone. The identified hearing situation is then for the most part taken as a basis for performing adaptation of the or the respective signal processing algorithm to suit the characteristic properties of the present hearing situation. In particular, the hearing apparatus is thereby intended to forward the information relevant to the user in accordance with the hearing situation. For example, the clearest possible output of music requires different settings (parameter values of different parameters) for the or one of the signal processing algorithm(s) than intelligible output of speech when there is a loud ambient noise. The detected hearing situation is then taken as a basis for altering the correspondingly assigned parameters.

Usual hearing situations are e.g. speech in silence, speech with noise, listening to music, (driving in a) vehicle. To analyze the ambient sound (specifically the microphone signal) and to detect the respective hearing situations, different features are first of all derived from the microphone signal (or an input signal formed therefrom) in this case. These features are supplied to the classifier, which uses analysis models such as e.g. what is known as a "Gaussian mixed mode analysis", a "hidden Markov model", a neural network or the like to output probabilities for the presence of particular hearing situations.

Frequently, a classifier is "trained" for the respective hearing situations by means of databases that store a multiplicity of different representative hearing samples for the respective hearing situation. A disadvantage of this, however, is that for the most part not all the combinations of sounds that possibly occur in everyday life can be mapped in such a database. This alone therefore means that some hearing situations can be incorrectly classified.

SUMMARY OF THE INVENTION

The invention is based on the object of allowing an improved hearing apparatus.

This object is achieved according to the invention by a method for operating a hearing apparatus having the features of the first independent claim. Moreover, this object is achieved according to the invention by a hearing apparatus having the features of the second independent claim. Embodiments and further developments of the invention that are advantageous and in some cases inventive in themselves are presented in the sub claims and the description that follows.

The method according to the invention is used for operating a hearing apparatus that has at least one microphone for converting ambient sound into a microphone signal. The method involves a number of features being derived from the microphone signal or an input signal formed therefrom in this case. At least three classifiers, which are implemented independently of one another for the purpose of analyzing a respective (preferably firmly) assigned acoustic dimension, are each supplied with a specifically assigned selection from these features. The respective classifier is subsequently used to generate a respective piece of information about a manifestation of the acoustic dimension assigned to this classifier. At least one of the at least three pieces of information about the respective manifestation of the assigned acoustic dimension is then taken as a basis for altering at least one signal processing algorithm that is executed for the purpose of processing the microphone signal or the input signal to produce an output signal.

Alteration of the signal processing algorithm is understood here and below to mean in particular that at least one parameter included in the signal processing algorithm is set to a different parameter value on the basis of manifestation of the acoustic dimension or at least one of the acoustic dimensions. In other words, a different setting for the signal processing algorithm is "delivered" (i.e. prompted or made).

The term "acoustic dimension" is understood here and below to mean in particular a group of hearing situations that are related on the basis of their specific properties. Preferably, the hearing situations mapped in an acoustic dimension of this kind are each described by the same features and differ in this case in particular on the basis of the current value of the respective features.

The term "manifestation" of the respective acoustic dimension is understood here and below to mean in particular whether (as for a binary distinction) or (in a preferred variant) to what degree (for example in what percentage) the or the respective hearing situation mapped in the respective acoustic dimension is present. Such a degree or percentage is preferably a probability value for the presence of the respective hearing situation in this case. By way of example, the hearing situations "speech in silence", "speech with noise" or (in particular only) "noise" (i.e. there is no speech) may be mapped in an acoustic dimension geared to the presence of speech in this case, the information about the manifestation preferably in turn including respective percentages (for example 30% probability of speech in the noise and 70% probability of only noise).

As described above, the hearing apparatus according to the invention contains at least the one microphone for converting the ambient sound into the microphone signal and also a signal processor in which at least the three classifiers described above are implemented independently of one another for the purpose of analyzing the respective (preferably firmly) assigned acoustic dimension. In this case, the signal processor is set up to perform the method according to the invention preferably independently. In other words, the signal processor is set up to derive the number of features from the microphone signal or the input signal to be formed therefrom, to supply each of the three classifiers with a specifically assigned selection from the features, to use the respective classifier to generate a piece of information about the manifestation of the respectively assigned acoustic dimension and to take at least one of the three pieces of information as a basis for altering at least one signal processing algorithm (preferably assigned in accordance with the acoustic dimension) and preferably applying it to the microphone signal or the input signal.

In a preferred configuration, the signal processor (also referred to as a signal processing unit) is formed at least in essence by a microcontroller having a processor and a data memory in which the functionality for performing the method according to the invention is implemented by means of programming in the form of a piece of operating software ("Firmware"), so that the method is performed automatically—if need be in interaction with a user of the hearing apparatus—on execution of the operating software in the microcontroller. Alternatively, the signal processor is formed by a nonprogrammable electronic device, e.g. an ASIC, in which the functionality for performing the method according to the invention is implemented using circuit-oriented means.

Since, according to the invention, at least three classifiers are set up and provided for the purpose of analyzing a respective assigned acoustic dimension and therefore in particular for detecting a respective hearing situation, it is advantageously possible for at least three hearing situations to be able to be detected independently of one another. This advantageously increases the flexibility of the hearing apparatus for detecting hearing situations. In this case, the invention is based on the insight that at least some hearing situations may also be present completely independently (i.e. in particular so as not to influence one another or to influence one another only insignificantly) of one another and in parallel with one another. The method according to the invention and the hearing apparatus according to the invention can therefore be used to decrease the risk of, at least in respect of the at least three acoustic dimensions analyzed by means of the respective assigned classifier, mutually exclusive and in particular inconsistent classifications (i.e. assessment of the acoustic situation currently present) arising. In particular, it is a simple matter for hearing situations that are present (completely) in parallel to be detected and to be taken into consideration for the alteration of the signal processing algorithm.

The hearing apparatus according to the invention has the same advantages as the method according to the invention for operating the hearing apparatus.

In a preferred method variant, multiple, i.e. at least two or more, signal processing algorithms are in particular used in parallel for the purpose of processing the microphone signal or the input signal. The signal processing algorithms in this case "operate" preferably on (at least) a respective assigned acoustic dimension, i.e. the signal processing algorithms are used for processing (for example filtering, amplifying, attenuating) signal components that are relevant to the hearing situations included or mapped in the respective assigned acoustic dimension. To adapt the signal processing on the basis of the manifestation of the respective acoustic dimension, the signal processing algorithms comprise at least one, preferably multiple, parameter(s) that can have it/their parameter values altered. Preferably, the parameter values can also be altered in multiple gradations (gradually or continually) in this case on the basis of the respective probability of the manifestation. This allows particularly flexible signal processing that is advantageously adaptable to suit a multiplicity of gradual differences between multiple hearing situations.

In an expedient method variant, at least two of the at least three classifiers are each supplied with a different selection from the features. This is understood here and below to mean in particular that a different number and/or different features are selected for the respective classifier and supplied thereto.

The conjunction "and/or" is intended to be understood here and below to mean that the features linked by means of this conjunction may be configured either jointly or as an alternative to one another.

In a further expedient method variant, only the features that are relevant to an analysis of the respectively assigned acoustic dimension are supplied together with the appropriately assigned selection to the respective classifier. In other words, for each classifier preferably only the features that are also actually necessary for determining the hearing situation mapped in the respective acoustic dimension are selected and supplied. As a result, advantageously computation complexity and outlay for the implementation of the respective classifier can be saved for the analysis of the respective acoustic dimension, since features that are irrelevant to the respective acoustic dimension can be ignored from the outset. Advantageously, this also allows a further decrease in the risk of incorrect classification on account of irrelevant features mistakenly being taken into consideration.

In an advantageous method variant, in particular if only the respectively relevant features are used in each classifier, a specific analysis algorithm for evaluating the (respective specifically) supplied features is used for each of the classifiers. This in turn also advantageously allows computation complexity to be saved. Moreover, comparatively complicated algorithms or analysis models such as e.g. Gaussian mixed modes, neural networks or hidden Markov models, which are used in particular for analyzing a multiplicity of different, mutually independent features, can be dispensed with. Instead, in particular each of the classifiers is therefore "tailored" (i.e. adapted or designed) for a specific "problem", i.e. in respect of its analysis algorithm for the acoustic dimension specifically assigned to this classifier. The comparatively complex analysis models described above can nevertheless be used for specific acoustic dimensions within the context of the invention, the orientation of the applicable classifier to one or a few hearing situations that the specific acoustic dimension comprises meaning that outlay for the implementation of such a comparatively complex model can be saved in this case too.

In a preferred method variant, the at least three acoustic dimensions used are in particular the dimensions "vehicle", "music" and "speech". In particular, within the respective acoustic dimension, it is therefore ascertained whether the user of the hearing apparatus is in a vehicle, is actually driving in this vehicle, is listening to music or whether there is speech. In the latter case, it is ascertained, preferably within the context of this acoustic dimension, whether there is speech in silence, speech with noise or no speech and in that case preferably only noise. These three acoustic dimensions are in particular the dimensions that usually arise particularly frequently in the everyday life of the user of the hearing apparatus and in this case are also independent of one another. In an optional development of this method variant, a fourth classifier is used for the purpose of analyzing a fourth acoustic dimension, which is in particular the loudness (also: "volume") of ambient sounds (also referred to as "noise"). In this case, the manifestations of this acoustic dimension extend from very quiet to very loud, preferably gradually or continually over multiple intermediate levels. The information regarding the manifestations in particular of the vehicle and music acoustic dimensions may, in contrast, optionally be "binary", i.e. it is only detected whether or not there is driving in the vehicle, or whether or not music is being listened to. Preferably, however, all the information from the other three acoustic dimensions is present continually as a type of probability value. This is in particular advantageous because errors in the analysis of the respective acoustic dimension cannot be ruled out, and because, in contrast to binary information, this also allows "softer" transitions between different settings to be caused in a simple manner.

In additional or optionally alternative developments, further classifiers for wind and/or reverberation estimation and for detection of the hearing apparatus wearer's own voice are respectively used.

In an expedient method variant, features are derived from the microphone signal or the input signal that are selected from a (in particular nonconclusive) group that comprises in particular the features signal level, 4-Hz envelope modulation, onset content, level of a background noise (also referred to as "noise floor level", optionally at a prescribed frequency), spectral focus of the background noise, stationarity (in particular at a prescribed frequency), tonality and wind activity.

In a further expedient method variant, the vehicle acoustic dimension is assigned at least the features level of the background noise, spectral focus of the background noise and stationarity (and optionally also the feature of wind activity). The music acoustic dimension is preferably assigned the features onset content, tonality and level of the background noise. The speech acoustic dimension is in particular assigned the features onset content and 4-Hz envelope modulation. The loudness of the ambient noise dimension that possibly exists is in particular assigned the features level of the background noise, signal level and spectral focus of the background noise.

In a further expedient method variant, a specifically assigned temporal stabilization is taken into consideration for each classifier. In particular, for some of the classifiers, preferably when the presence of a hearing situation has already been detected in the past (for example in a preceding period of time of prescribed length) (i.e. in particular for a determined manifestation of the acoustic dimension), it is assumed in this case that this state (the manifestation) then also has a high probability of still being present at the current time. By way of example, a moving average over (in particular a prescribed number of) preceding periods of time is formed in this regard. Alternatively, it is also possible for a kind of "dead timing element" to be provided, which is used, in a subsequent period of time, to increase the probability of the manifestation that is present in the preceding period of time still being present. By way of example, it is assumed, if driving in the vehicle has been detected in the preceding five minutes, which this situation continues to be present. Preferably for the vehicle and music dimensions, comparatively "strong" stabilizations are used, i.e. only comparatively slow or rare alterations in the correspondingly assigned hearing situations are assumed. For the speech dimension, on the other hand, expediently no or only a "weak" stabilization is performed, since in this case fast and/or frequent alterations in the hearing situations are assumed. Speech situations can often last only a few seconds (for example approximately 5 seconds) or a few minutes, whereas driving in the vehicle is present for the most part for several minutes (for example more than 3 to 30 minutes or even hours). A further optional variant for the stabilization can also be provided by means of a counting principle, in which a counter is incremented in the event of comparatively fast (for example 100 milliseconds to a few seconds) detection timing and the "detection" of the respective hearing situation is triggered only in the event of a limit value for this counter being exceeded. This is expedient for "all" hearing situations as short-term stabilization in the case of a joint classifier, for example. A conceivable variation for the stabilization in the present case is to assign a specific limit value to each hearing situation and to lower said limit value in particular for the hearing situation "traveling in the vehicle" and/or "listening to music" if the respective hearing situation has already been detected for a prescribed prior period of time, for example.

In a further expedient method variant, the or the respective signal processing algorithm is adapted on the basis of at least two of the at least three pieces of information about the manifestation of the respective assigned acoustic dimension. In at least one signal processing algorithm, the information of multiple classifiers is thus taken into consideration.

In an expedient method variant, the respective information of the individual classifiers is in particular first of all supplied to a fusion element ("fused") to produce a joint evaluation. This joint evaluation of all the information is used in particular to create a piece of overall information about the hearing situations that are present. Preferably, this involves a dominant hearing situation being ascertained—in particular on the basis of the degree of the manifestation, which conveys the probability. The or the respective signal processing algorithm is adapted to suit this dominant hearing situation in this case. Optionally a hearing situation (namely the dominant one) is prioritized in this case by virtue of the or the respective signaling processing algorithm being altered only on the basis of the dominant hearing situation, while other signal processing algorithms and/or the parameters dependent on other hearing situations remain unaltered or are set to a parameter value that has no influence on the signal processing.

In a development of the method variant described above, the joint evaluation of all the information is used in particular to ascertain a hearing situation referred to as a subsituation, which has lower dominance in comparison with the dominant hearing situation. This or the respective subsituation is additionally taken into consideration for the aforementioned adaptation of the or the respective signal processing algorithm to suit the dominant hearing situation and/or for adapting a signal processing algorithm specifically assigned to the acoustic dimension of this subsituation. In particular, this subsituation leads to a smaller alteration in the or the respective assigned parameter in this case in comparison with the dominant hearing situation. If speech in the noise is ascertained as the dominant hearing situation and music is ascertained as the subsituation, for example, a signal processing algorithm that serves for the clearest possible intelligibility of speech among noise then has one or more parameters altered to a comparatively great extent in order to achieve the highest possible intelligibility of speech. Since music is also present, however, parameters that are used for attenuating ambient noise are set to a lesser degree (than if only noise is present) so as not to attenuate the sounds of the music completely. A (in particular additional) signal processing algorithm used for clear sound reproduction of music is moreover set to a lesser extent in this case than when music is the dominant hearing situation (but to a greater extent than when there is no music), so as not to mask the speech components. Therefore, in particular on account of the mutually independent detection of different hearing situations and on account of the finer adaptation of the signal processing algorithms that becomes possible as a result, particularly precise adaptation of the signal processing of the hearing apparatus to suit the actually present hearing situation can take place.

As already described above, the parallel presence of multiple hearing situations is preferably taken into consideration in at least one of the possibly multiple signal processing algorithms.

In an alternative method variant, the or preferably each signal processing algorithm is assigned to at least one of the classifiers. In this case, preferably at least one parameter of each signal processing algorithm is altered (in particular immediately) on the basis of the information about the manifestation of the assigned acoustic dimension that is output by the respective classifier. Preferably, this parameter or the parameter value thereof is configured as a function of the respective information. Therefore, the information about the manifestation of the respective acoustic dimension is in particular used directly for adaptation of the signal processing. In other words, each classifier "controls" at least one parameter of at last one signal processing algorithm. Joint evaluation of all the information can be omitted in this case. In particular, in this case, a particularly large amount of information about the distribution of the mutually independent hearing situations in the currently present "image" described by the ambient sound is taken into consideration, so that again particularly fine adaptation of the signal processing is promoted. In particular, it is also possible for completely parallel hearing situations—for example 100% speech in the noise at the same time as 100% traveling in the vehicle, or 100% music at the same time as 100% traveling in the vehicle—to be taken into consideration easily and with little loss of information in this case.

In a further expedient method variant, at least one of the classifiers is supplied with a piece of state information that is produced independently of the microphone signal or the input signal. The state information is in particular taken into consideration in addition to the evaluation of the respective acoustic dimension in this case. By way of example, it is a piece of movement and/or location information that is used to evaluate the vehicle acoustic dimension, for example. This movement and/or location information is produced, by way of example, using an acceleration or (global) position sensor arranged in the hearing apparatus itself or in a system (for example a smartphone) connected thereto for signal transmission purposes. By way of example, on the basis of an existing speed of movement (having a prescribed value) during the evaluation of the vehicle acoustic dimension, the probability of the presence of the traveling in the vehicle hearing situation can easily be increased in addition to the acoustic evaluation in this case. This is also referred to as "augmentation" of a classifier.

Other features which are considered as characteristic for the invention are set forth in the appended claims.

Although the invention is illustrated and described herein as embodied in a method for operating a hearing apparatus, and hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts and variables that correspond to one another are provided with the same reference symbols throughout the figures.

Figure 1:
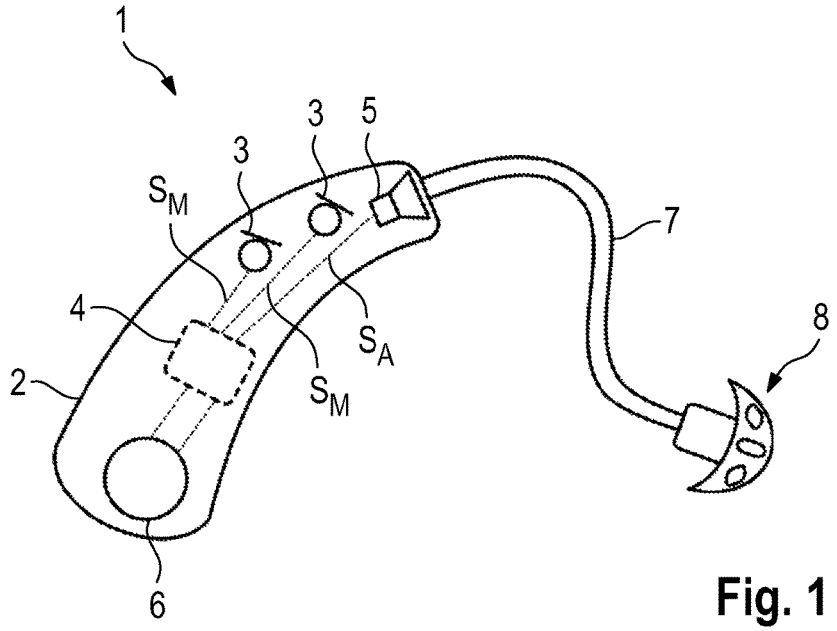
FIG. 1 is an illustration of a hearing apparatus according to the invention.

Referring now to the figures of the drawings in detail and first, particularly to FIG. 1 thereof, there is shown a hearing aid, referred to as "hearing device 1", as a hearing apparatus. As electrical components accommodated in a housing 2, the hearing device 1 has two microphones 3, a signal processor 4 and a loudspeaker 5. To supply power to the electrical components, the hearing device 1 moreover has a battery 6, which may alternatively be configured as a primary cell (for example as a button cell) or as a secondary cell (i.e. as a rechargeable battery). The microphone 3 is used to capture ambient sound during operation of the hearing device 1 and to produce a respective microphone signal $S_M$ from the ambient sound. These two microphone signals $S_M$ are supplied to the signal processor 4, which executes four signal processing algorithms $A_1$, $A_2$, $A_3$ and $A_4$ to generate an output signal $S_A$ from these microphone signals $S_M$ and outputs the output signal to a loudspeaker 5, which is an output transducer. The loudspeaker 5 converts the output signal $S_A$ into airborne sound, which is output to the ear of the user or wearer (hearing device wearer) of the hearing device 1 via a sound tube 7 adjoining the housing 2 and an earpiece 8 (in the intended wearing state of the hearing device 1) connected to the end of the sound tube 7.

Figure 2:
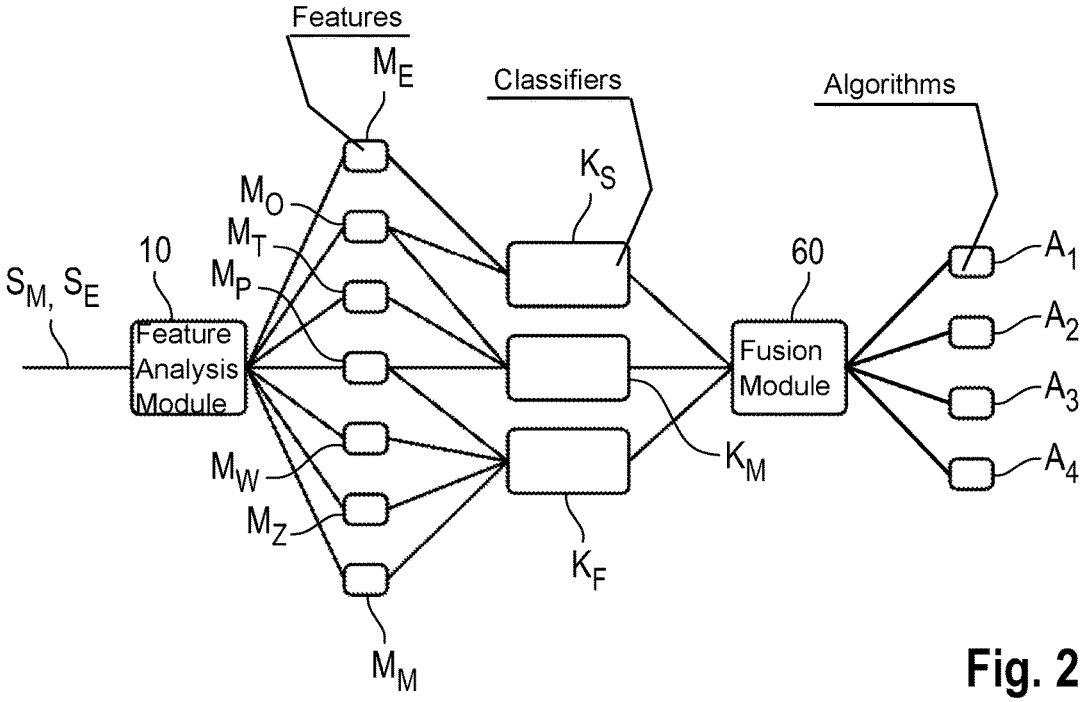
FIG. 2 is a schematic block diagram of a signal flow diagram for the hearing apparatus shown in FIG. 1.

To detect different hearing situations and to subsequently adapt the signal processing, the hearing device 1, specifically the signal processor 4 thereof, is set up to automatically perform a method that is described in more detail below with reference to FIG. 2 and FIG. 3. As depicted in more detail in FIG. 2, the hearing device 1, specifically the signal processor 4 thereof, has at least three classifiers $K_S$, $K_M$ and $K_F$. These three classifiers $K_S$, $K_M$ and $K_F$ are in this case each set up and configured to analyze a specifically assigned acoustic dimension. The classifier $K_S$ is specifically configured to evaluate the acoustic dimension "speech", i.e. whether speech, speech in noise or only noise is present. The classifier $K_M$ is specifically configured to evaluate the acoustic dimension "music", i.e. whether the ambient sound is dominated by music. The classifier $K_F$ is specifically configured to evaluate the acoustic dimension "vehicle", i.e. to determine whether the hearing device wearer is traveling in the vehicle. The signal processor 4 moreover has a feature analysis module 10 (also referred to as a "feature extraction module") that is set up to derive a number of (signal) features from the microphone signals $S_M$, specifically from an input signal $S_E$ formed from these microphone signals $S_M$. The classifiers $K_S$, $K_M$ and $K_F$ are in this case each supplied with a different and specifically assigned selection from these features. On the basis of these specifically supplied features, the respective classifier $K_S$, $K_M$ or $K_F$ ascertains a manifestation of the respective assigned acoustic dimension, i.e. to what degree a hearing situation specifically assigned to the acoustic dimension is present, and outputs this manifestation as a respective piece of information.

Figure 3:
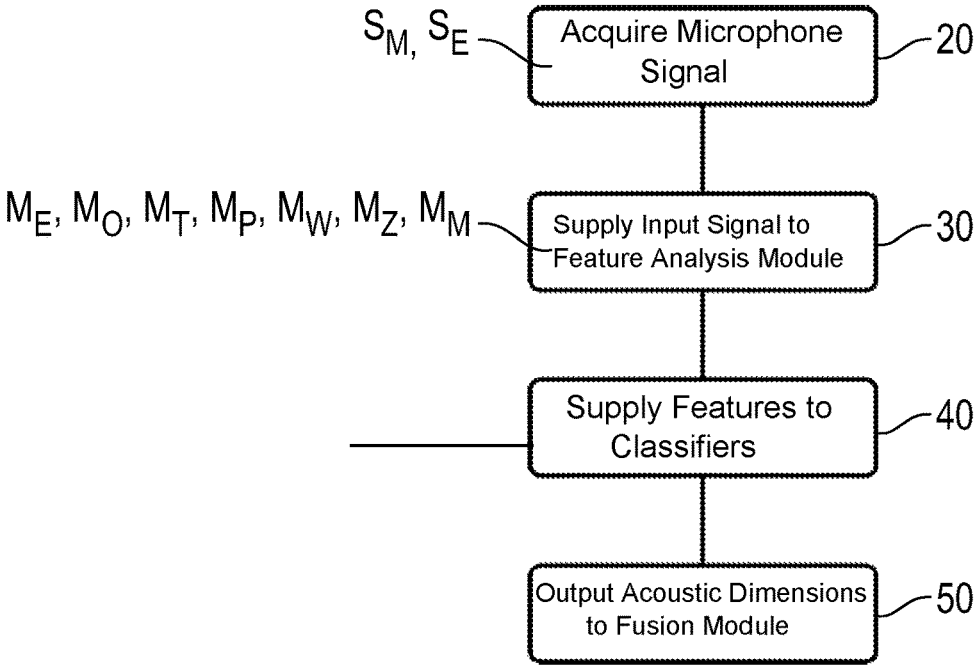
FIG. 3 is a schematic flowchart showing a method for operating the hearing apparatus shown in FIG. 1.

Specifically, as revealed by FIG. 3, a first method step 20 involves the microphone signals $S_M$ being produced from the captured ambient sound and being combined by the signal processor 4 to produce the input signal $S_E$ (specifically mixed to produce a directional microphone signal). A second method step 30 involves the input signal $S_E$ formed from the microphone signals $S_M$ being supplied to the feature analysis module 10 and the number of features being derived by the latter. The features specifically (but not conclusively) ascertained in this case are the level of a background noise (feature "$M_P$"), a spectral focus of the background noise (feature "$M_Z$"), a stationarity of the signal (feature "$M_M$"), a wind activity (feature "$M_W$"), an onset content of the signal (feature "$M_O$"), a tonality (feature "$M_T$") and a 4-hertz envelope modulation (feature "$M_E$"). A method step 40 involves the classifier $K_S$ being supplied with the features $M_E$ and $M_O$ for analysis of the speech acoustic dimension. The classifier $K_M$ is supplied with the features $M_O$, $M_T$ and $M_P$ for analysis of the music acoustic dimension. The classifier $K_F$ is supplied with the features $M_P$, $M_W$, $M_Z$ and $M_M$ for analysis of the traveling in the vehicle acoustic dimension. On the basis of the respectively supplied features, classifiers $K_S$, $K_M$ and $K_F$ then use specifically adapted analysis algorithms to ascertain the extent to which, i.e. the degree to which, the respective acoustic dimension is manifested. Specifically, the classifier $K_S$ is used to ascertain the probability with which speech in silence, speech in noise or only noise is present. The classifier $K_M$ is accordingly used to ascertain the probability with which music is present. The classifier $K_F$ is used to ascertain the probability with which the hearing device wearer is traveling or not traveling in a vehicle.

In an alternative exemplary embodiment, there is merely "binary" ascertainment of whether or not speech, possibly in noise, or only noise, or music or traveling in the vehicle is present.

The respective manifestation of the acoustic dimensions is output to a fusion module 60 in the method step 50 (see FIG. 2) by virtue of the respective pieces of information being combined and compared with one another. In the fusion module 60, a decision is moreover made as to which dimension, specifically which hearing situation mapped therein, can currently be regarded as dominant and which hearing situations are currently of subordinate importance or can be ruled out completely. Subsequently, the fusion module, given a number of the stored signal processing algorithms $A_1$ to $A_4$, alters a respective number of parameters relating to the dominant and the less relevant hearing situations, so that the signal processing is primarily adapted to suit the dominant hearing situation and less to suit the less relevant hearing situation. Each of the signal processing algorithms $A_1$ to $A_4$ is respectively adapted to suit the presence of a hearing situation, if need be also in parallel with other hearing situations.

The classifier $K_F$ contains temporal stabilization in this case in a manner not depicted in more detail. The temporal stabilization is in particular geared to a journey in the vehicle usually lasting a relatively long time, and therefore, in the event of traveling in the vehicle having already been detected in preceding periods of time, each of 30 seconds to five minutes in duration, for example, and on the assumption that the traveling in the vehicle situation is still ongoing, the probability of the presence of this hearing situation already being increased in advance. The same is also set up and provided for in the classifier $K_M$.

Figure 4:
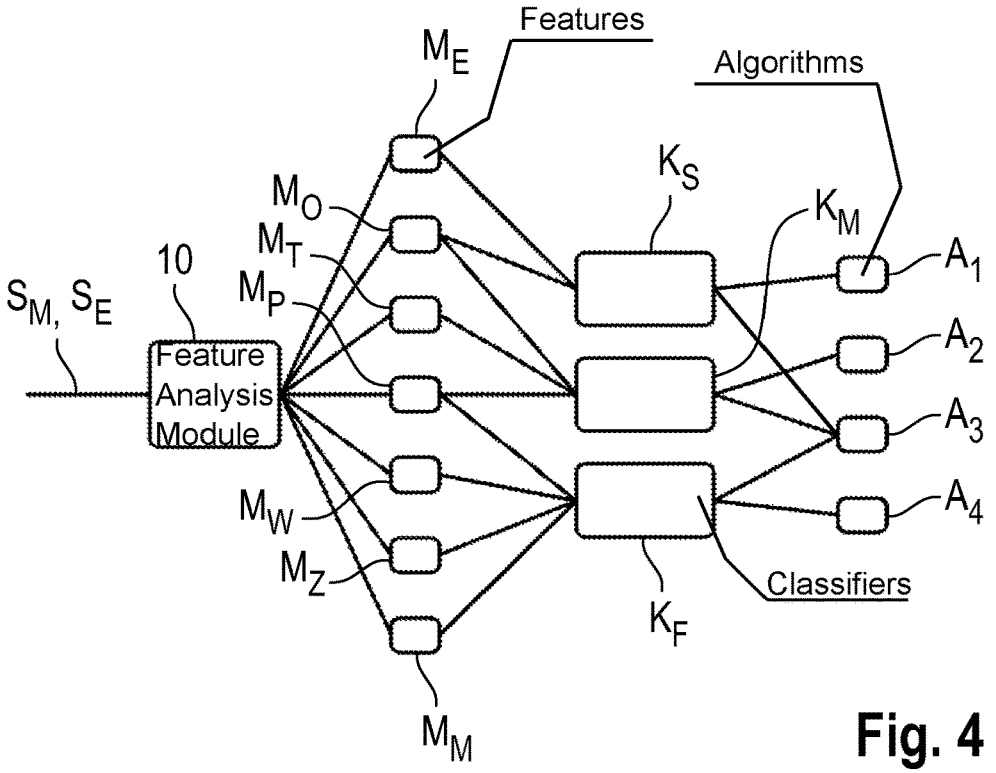
FIG. 4 is a schematic block diagram showing a view as shown in FIG. 2 of an alternative exemplary embodiment of the signal flow diagram.

In an alternative exemplary embodiment as shown in FIG. 4, the fusion module 60 is absent from the signal flow diagram depicted. In this case, each of the classifiers $K_S$, $K_M$ and $K_F$ is assigned at least one of the signal processing algorithms $A_1$, $A_2$, $A_3$ and $A_4$ such that multiple parameters included in the respective signal processing algorithm $A_1$, $A_2$, $A_3$ and $A_4$ are designed to be alterable as a function of the manifestations of the respective acoustic dimension. That is to say that the respective information about the respective manifestation is taken as a basis for altering at least one parameter immediately—i.e. without interposed fusion. Specifically, in the exemplary embodiment depicted, the signal processing algorithm $A_1$ is dependent only on the information of the classifier $K_S$. By contrast, the signal processing algorithm $A_3$ receives the information of all the classifiers $K_S$, $K_M$ and $K_F$, the information resulting in the alteration of multiple parameters therein.

The subject matter of the invention is not restricted to the exemplary embodiments described above. Rather, further embodiments of the invention can be derived from the description above by a person skilled in the art. In particular, the individual features of the invention that are described with reference to the various exemplary embodiments, and the configuration variants of said invention, can also be combined with one another in a different way. As such, the hearing device 1 may also be configured as an in the ear hearing device instead of the behind the ear hearing device depicted, for example.

The following is a summary list of reference numerals and the corresponding structure used in the above description of the invention:

1 Hearing device
2 Housing
3 Microphone
4 Signal processor
5 Loudspeaker
6 Battery
7 Sound tube
8 Earpiece
10 Feature analysis module
20 Method step
30 Method step

40 Method step
50 Method step
60 Fusion module
$A_1$-$A_4$ Signal processing algorithm
$K_S$, $K_M$, $K_F$ Classifier
$M_E$, $M_O$, $M_T$, $M_P$, $M_W$, $M_Z$, $M_M$ Feature
$S_A$ Output signal
$S_E$ Input signal
$S_M$ Microphone signal

The invention claimed is:

1. A method for operating a hearing apparatus having at least one microphone for converting ambient sound into a microphone signal, which comprises the steps of:

deriving a plurality of features from the microphone signal or an input signal formed from the microphone signal;

supplying the features to at least three classifiers, the classifiers being implemented independently of one another for analyzing a respectively assigned acoustic dimension, each of the classifiers being supplied with a specifically assigned selection of the features;

generating, via a respective classifier, a respective piece of information about a manifestation of the respectively assigned acoustic dimension assigned to the respective classifier, the respective piece of information is a probability value regarding an occurrence of the respectively assigned acoustic dimension; and taking at least one of at least three pieces of information about the manifestation of the respectively assigned acoustic dimension as a basis for altering at least one signal processing algorithm that is executed for processing the microphone signal or the input signal to produce an output signal.

2. The method according to claim 1, which further comprises supplying at least two of the at least three classifiers with a different selection of the features.

3. The method according to claim 1, wherein only the features that are relevant to an analysis of the respectively assigned acoustic dimension are supplied together with an appropriately assigned selection to the respective classifier.

4. The method according to claim 1, which further comprises using a specific analysis algorithm for evaluating the features supplied to each of the classifiers.

5. The method according to claim 1, wherein at least three acoustic dimensions are used including vehicle, music and speech.

6. The method according to claim 5, which further comprises:

assigning a vehicle acoustic dimension at least the features of the level of the background noise, the spectral focus of the background noise and the stationarity;

assigning a music acoustic dimension the features of the onset content, the tonality and the level of the background noise; and assigning a speech acoustic dimension the features of the onset content and the 4-hertz envelope modulation.

7. The method according to claim 1, wherein the features of signal level, 4-hertz envelope modulation, onset content, level of a background noise, spectral focus of the background noise, stationarity, tonality, and wind activity are derived from the microphone signal or the input signal.

8. The method according to claim 1, which further comprises taking into consideration a specifically assigned temporal stabilization for each of the classifiers.

9. The method according to claim 1, which further comprises altering the signal processing algorithm on a basis of at least two of the at least three pieces of information about the manifestation of the respectively assigned acoustic dimension.

10. The method according to claim 1, which further comprises supplying the information of the classifiers to a joint evaluation, wherein the joint evaluation is taken as a basis for ascertaining a dominant hearing situation, and wherein a respective signal processing algorithm is adapted to suit a dominant hearing situation.

11. The method according to claim 10, which further comprises ascertaining at least one subsituation having lower dominance in comparison with the dominant hearing situation, and a respective subsituation is taken into consideration when the signal processing algorithm is altered.

12. The method according to claim 1, which further comprises:

using a plurality of signal processing algorithms for processing the microphone signal; and assigning each of the signal processing algorithms at least one of the classifiers, and at least one parameter of each of the signal processing algorithms is altered on a basis of information about the manifestation of an applicable acoustic dimension that is output by the classifier assigned thereto.

13. The method according to claim 1, which further comprises supplying at least one of the classifiers with a piece of state information that is produced independently of the microphone signal or the input signal and that is additionally taken into consideration for evaluating the respectively assigned acoustic dimension.

14. A hearing apparatus, comprising:

at least one microphone for converting ambient sound into a microphone signal; and a signal processor, in which at least three classifiers are implemented independently of one another for analyzing a respectively assigned acoustic dimension, said signal processor programmed to:

derive a plurality of features from the microphone signal or an input signal formed from the microphone signal;

supplying the features to said at least three classifiers, each of said classifiers being supplied with a specifically assigned selection of the features;

generating, via a respective classifier, a respective piece of information about a manifestation of the respectively assigned acoustic dimension assigned to said respective classifier, the respective piece of information is a probability value regarding an occurrence of the respectively assigned acoustic dimension; and taking at least one of at least three pieces of information about the manifestation of the respectively assigned acoustic dimension as a basis for altering at least one signal processing algorithm that is executed for processing the microphone signal or the input signal to produce an output signal.

* * * * *